US010288280B2

(12) United States Patent
Giove

(10) Patent No.: US 10,288,280 B2
(45) Date of Patent: May 14, 2019

(54) DUAL CONE SPRAY NOZZLE ASSEMBLY FOR HIGH TEMPERATURE ATTEMPERATORS

(71) Applicant: Control Components, Inc., Rancho Santa Margarita, CA (US)

(72) Inventor: Fabio Giove, Gioia del Colle (IT)

(73) Assignee: CCI Italy SRL, Milan (IT)

( * ) Notice: Subject to any disclaimer, the term of this patent is extended or adjusted under 35 U.S.C. 154(b) by 110 days.

(21) Appl. No.: 14/816,909

(22) Filed: Aug. 3, 2015

(65) Prior Publication Data

US 2016/0033124 A1 Feb. 4, 2016

Related U.S. Application Data

(60) Provisional application No. 62/032,786, filed on Aug. 4, 2014.

(51) Int. Cl.
*F22G 5/12* (2006.01)
*B05B 1/14* (2006.01)
(Continued)

(52) U.S. Cl.
CPC ..... *F22G 5/123* (2013.01); *B05B 1/14* (2013.01); *B05B 1/3066* (2013.01);
(Continued)

(58) Field of Classification Search
CPC ..... B05B 1/3073; B05B 1/02; B05B 1/06; B05B 1/14; B05B 1/3066; B05B 1/323; F22G 5/123
(Continued)

(56) References Cited

U.S. PATENT DOCUMENTS 355,250 A 12/1886 Talmadge
1,252,254 A 1/1918 Fisher
(Continued)

FOREIGN PATENT DOCUMENTS

DE 3713726 A1 11/1988
DE 3906579 A1 9/1990
(Continued)

OTHER PUBLICATIONS

International Search Report and Written Opinion for PCT/US2015/043647 dated Oct. 16, 2015.
(Continued)

*Primary Examiner* — Charles S Bushey
(74) *Attorney, Agent, or Firm* — Stetina Brunda Garred & Brucker

(57) ABSTRACT

A spray nozzle assembly for a steam desuperheating or attemperator device. In one embodiment, the spray nozzle sub-assembly of the spray nozzle assembly comprises a fixed nozzle element which is integrated into a spring-loaded nozzle element, and is specifically adapted to improve water droplet fractionation at higher flow rates while further providing an effectively higher spray area through the formation of two water cones (rather than a single water cone), such water cones being sprayed into a flow of superheated steam in order to reduce the temperature of the steam. In another embodiment, the spray nozzle sub-assembly of the spray nozzle assembly comprises a nested pair of spring-loaded primary and secondary nozzle elements which are also adapted to provide an effectively higher spray area through the formation of two water cones.

17 Claims, 5 Drawing Sheets

(51) Int. Cl.

| | |
|---|---|
| ***B05B 1/30*** | (2006.01) |
| ***B05B 1/32*** | (2006.01) |
| *B05B 1/02* | (2006.01) |
| *B05B 1/06* | (2006.01) |

(52) U.S. Cl.
CPC ..... *B05B 1/3073* (2013.01); *B05B 1/323* (2013.01); *B05B 1/02* (2013.01); *B05B 1/06* (2013.01)

(58) Field of Classification Search
USPC ..... 261/62, 66, 118, DIG. 13; 122/487; 137/542; 239/439, 440, 441
See application file for complete search history.

(56) References Cited

U.S. PATENT DOCUMENTS

| | | | |
|---|---|---|---|
| 1,313,971 | A | 8/1919 | Wilson |
| 1,486,156 | A | 3/1924 | Needham |
| 1,893,298 | A | 1/1933 | Moore |
| 2,127,188 | A | 8/1938 | Schellin et al. |
| 2,155,986 | A | 4/1939 | Wheaton |
| 2,277,811 | A | 3/1942 | Ashley et al. |
| 2,313,994 | A | 3/1943 | Grant |
| 2,323,464 | A | 7/1943 | Glessner |
| 2,355,458 | A | 8/1944 | Mastenbrook |
| 2,656,218 | A | 10/1953 | Campbell |
| 2,801,087 | A | 7/1957 | Hawk |
| 3,220,710 | A | 11/1965 | Forster |
| 3,286,935 | A | 11/1966 | Webster et al. |
| 3,331,590 | A | 7/1967 | Battenfeld et al. |
| 3,332,401 | A | 7/1967 | Lustenader |
| 3,434,500 | A | 3/1969 | Burrows |
| 3,589,621 | A | 6/1971 | Bradley |
| 3,655,164 | A | 4/1972 | Hayes |
| 3,732,851 | A | 5/1973 | Self |
| 3,917,221 | A | 11/1975 | Kubota et al. |
| 4,017,055 | A | 4/1977 | Daughetee et al. |
| 4,060,199 | A | 11/1977 | Brune |
| 4,071,586 | A | 1/1978 | Seger |
| 4,082,224 | A | 4/1978 | Mangus |
| 4,130,611 | A | 12/1978 | Brand |
| 4,179,069 | A | 12/1979 | Knapp et al. |
| 4,396,156 | A | 8/1983 | Southworth et al. |
| 4,442,047 | A | 4/1984 | Johnson |
| 4,479,908 | A | 10/1984 | Arbeille et al. |
| 4,512,520 | A | 4/1985 | Schoonover |
| 4,651,931 | A | 3/1987 | Hans et al. |
| 4,899,699 | A | 2/1990 | Huang et al. |
| 4,909,445 | A | 3/1990 | Schoonover |
| 4,925,111 | A | 5/1990 | Foertsch et al. |
| 4,944,460 | A | 7/1990 | Steingass |
| 4,991,780 | A | 2/1991 | Kannan et al. |
| 5,005,605 | A | 4/1991 | Kueffer et al. |
| 5,044,561 | A | 9/1991 | Holzgrefe |
| 5,058,549 | A | 10/1991 | Hashimoto et al. |
| 5,336,451 | A | 8/1994 | Lovick |
| 5,351,477 | A | 10/1994 | Joshi et al. |
| 5,364,033 | A | 11/1994 | Cedoz et al. |
| 5,385,121 | A | 1/1995 | Feiss |
| 5,465,906 | A | 11/1995 | Hans et al. |
| 5,607,626 | A | 3/1997 | Kunkle et al. |
| 5,785,257 | A | 7/1998 | Furuya et al. |
| 5,862,992 | A | 1/1999 | Stinson et al. |
| 6,062,499 | A | 5/2000 | Nakamura et al. |
| 6,619,568 | B2 | 9/2003 | Kunkle et al. |
| 6,691,929 | B1 | 2/2004 | Sherikar |
| 6,746,001 | B1 | 6/2004 | Sherikar |
| 6,764,032 | B2 | 7/2004 | Bulgatz et al. |
| 6,823,833 | B2 | 11/2004 | Ismailov |
| 7,028,976 | B2 | 4/2006 | Bachmann et al. |
| 7,028,994 | B2 | 4/2006 | Sherikar |
| 7,172,175 | B2 | 2/2007 | Vicars |
| 7,370,817 | B2 | 5/2008 | Tilton et al. |
| 7,481,058 | B2 | 1/2009 | Fukuda et al. |
| 7,654,509 | B2 | 2/2010 | Freitas et al. |
| 7,802,376 | B2 | 9/2010 | Huettlin |
| 7,850,149 | B2 | 12/2010 | Sherikar et al. |
| 7,891,374 | B2 | 2/2011 | Vicars |
| 2005/0194702 | A1 | 9/2005 | Sherikar |
| 2006/0125126 | A1 | 6/2006 | Sherikar et al. |
| 2010/0051728 | A1 | 3/2010 | Hicks et al. |
| 2012/0255523 | A1 | 10/2012 | Kim et al. |
| 2014/0091485 | A1* | 4/2014 | Watson ..... F22G 5/123 261/66 |
| 2014/0091486 | A1 | 4/2014 | Watson et al. |

FOREIGN PATENT DOCUMENTS

| | | | |
|---|---|---|---|
| DE | 10352544 | | 6/2005 |
| DE | 102006038536 | A1 | 2/2008 |
| EP | 501164 | A1 | 9/1992 |
| EP | 1180627 | A1 | 2/2004 |
| EP | 1992465 | A2 | 11/2008 |
| JP | 11082919 | | 3/1999 |
| JP | 2011519726 | T | 7/2011 |
| WO | 2004106792 | | 12/2004 |
| WO | 2009136967 | A1 | 11/2009 |
| WO | 2013077849 | A1 | 5/2013 |

OTHER PUBLICATIONS

Extended European Search Report for EP 15 82 9728; dated Jun. 27, 2018.

* cited by examiner

DUAL CONE SPRAY NOZZLE ASSEMBLY FOR HIGH TEMPERATURE ATTEMPERATORS

CROSS-REFERENCE TO RELATED APPLICATIONS

The present application claims priority to U.S. Provisional Application Ser. No. 62/032,786 entitled DUAL CONE SPRAY NOZZLE ASSEMBLY FOR HIGH TEMPERATURE ATTEMPERATORS filed Aug. 4, 2014.

STATEMENT RE: FEDERALLY SPONSORED RESEARCH/DEVELOPMENT

Not Applicable

BACKGROUND OF THE INVENTION

1. Field of the Invention

The present invention pertains generally to steam desuperheaters or attemperators and, more particularly, to a uniquely configured spray nozzle assembly for a steam desuperheating or attemperator device is, the spray nozzle assembly being adapted to improve the atomization performance of the nozzle at very low flow rates. In one embodiment, the spray nozzle sub-assembly of the spray nozzle assembly comprises a fixed nozzle element which is integrated into a spring-loaded nozzle element. The spray nozzle sub-assembly is specifically adapted to improve water droplet fractionation at lower flow rates through the use of only the smaller, central fixed nozzle element, and at high flow rates through the concurrent use of the fixed and spring-loaded nozzle elements. Though at low flow rates, the spring-loaded nozzle element is generally ineffective in water fractionation, high flow rates facilitate the transmission of two spray cones from spray nozzle sub-assembly, one associated with the fixed nozzle element being positioned within one associated with the spring-loaded nozzle element. The double spray cone is able to provide good results at high flow rates by producing an effectively higher spray area through the formation of two water cones (rather than a single water cone), such water cones being sprayed into a flow of superheated steam in order to reduce the temperature of the steam. In another embodiment, the spray nozzle sub-assembly of the spray nozzle assembly comprises a nested pair of spring-loaded primary and secondary nozzle elements which are also adapted to provide an effectively higher spray area through the formation of two water cones.

2. Description of the Related Art

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional deviations from a prescribed operating temperature set point. Along these lines, the precise control of final steam temperature is often critical for the safe and efficient operation of steam generation cycles.

A steam desuperheater or attemperator can lower the temperature of superheated steam by spraying cooling water into a flow of superheated steam that is passing through a steam pipe. Attemperators typically comprise one or more spray nozzles or nozzle assemblies positioned so as to spray cooling water into the steam flow. By way of example, attemperators are often utilized in heat recovery steam generators between the primary and secondary superheaters on the high pressure and the reheat lines. In some designs, attemperators are also added after the final stage of superheating. Once the cooling water is sprayed into the flow of superheated steam, the cooling water mixes with the superheated steam and evaporates, drawing thermal energy from the steam and lowering its temperature.

With regard to the functionality of any spray nozzle assembly of an attemperator, if the cooling water is sprayed into the superheated steam pipe as very fine water droplets or mist, then the mixing of the cooling water with the superheated steam is more uniform through the steam flow. On the other hand, if the cooling water is sprayed into the superheated steam pipe in a streaming pattern, then the evaporation of the cooling water is greatly diminished. In addition, a streaming spray of cooling water will typically pass through the superheated steam flow and impact the interior wall or liner of the steam pipe, resulting in water buildup which can cause erosion, thermal stresses, and/or stress corrosion cracking in the liner of the steam pipe that may lead to its structural failure. However, if the surface area of the cooling water spray that is exposed to the superheated steam is large, which is an intended consequence of very fine droplet size, the effectiveness of the evaporation is greatly increased. Further, the mixing of the cooling water with the superheated steam can be enhanced by spraying the cooling water into the steam pipe in a uniform geometrical flow pattern such that the effects of the cooling water are uniformly distributed throughout the steam flow. Conversely, a non-uniform spray pattern of cooling water will result in an uneven and poorly controlled temperature reduction throughout the flow of the superheated steam. Along these lines, the inability of the cooling water spray to efficiently evaporate in the superheated steam flow may also result in an accumulation of cooling water within the steam pipe. The accumulation of this cooling water, in addition to potentially causing the problems highlighted above, will eventually evaporate in a non-uniform heat exchange between the water and the superheated steam, resulting in a poorly controlled temperature reduction.

In the current generation of combined cycle power plants, there is an increased interest in reducing the minimum load to which the plant is able to operate. The manner of plant operation, often referred to as "park-load," effectively reduces the minimum load of the plant as the power generated is produced with a bypass valve in a partial opening mode. This mode of operation requires that smaller flows of steam be quenched and controlled through the use of the aforementioned attemperators.

However, the designs of the spray nozzle assemblies of currently know attemperators are not particularly well suited for "park-load" plant operation. In this regard, in many current nozzle assembly designs, the valve or spray nozzle element thereof is energized by a spring and is set to a prescribed break-up pressure as is controlled by an upstream control valve. The pressure drop on the nozzle assembly when the nozzle element thereof is actuated to its open position facilitates the generation of a cone of water that is broken into multiple droplets which are mixed into the flow of high temperature steam. However, when using such nozzle assemblies to cool steam at lower flow rates, a low pressure similar to the nozzle assembly break-up pressure will typically result in the generation of a single jet of water, rather than a cone-shaped flow of water mist, thus not guaranteeing good control of steam attemperation.

The present invention addresses these and other deficiencies of currently known spray nozzle assemblies. In this regard, various novel features of the present invention will be discussed in more detail below.

SUMMARY OF THE INVENTION

In accordance with the present invention, there is provided a spray nozzle assembly for an attemperator which is operative to spray cooling water into a flow of superheated steam in a generally uniformly distributed spray pattern comprising two water cones, one being nested or concentrically positioned within the other. The spray nozzle assembly comprises a nozzle housing and a spray nozzle sub-assembly which is movably interfaced to the nozzle housing. The spray nozzle sub-assembly extends through the s nozzle housing and is axially movable between a closed position and an open (flow) position. The nozzle housing defines a generally annular flow passage. In one exemplary embodiment, the flow passage itself comprises three identically configured, arcuate flow passage sections, each of which spans an interval of approximately 120°. One end of each of the flow passage sections extends to a first (top) end or end portion of the nozzle housing. The opposite end of each of the flow passage sections fluidly communicates with a fluid chamber which is also defined by the nozzle housing and extends to a second (bottom) end of the nozzle housing which is disposed in opposed relation to the first end thereof. A portion of the second end of the nozzle housing which circumvents the fluid chamber defines a seating surface of the spray nozzle assembly. The nozzle housing further defines a central bore which extends axially from the first end thereof. The central bore may be fully or at least partially circumvented by the annular flow passage collectively defined by the separate flow passage sections, the central bore thus being concentrically positioned relative to the flow passage sections. That end of the central bore opposite the end extending to the first end of the spray nozzle housing terminates at the fluid chamber.

In accordance with a first embodiment of the present invention, the spray nozzle sub-assembly of the spray nozzle assembly comprises a fixed nozzle element which is integrated into a spring-loaded nozzle element. The fixed nozzle element works in concert with the spring-loaded nozzle element to provide better control over droplet size at low flow/low pressure drop conditions. In addition, such spray nozzle sub-assembly is adapted to improve water droplet fractionation at higher flow rates while further providing an effectively higher spray area through the formation of two water cones (rather than a single water cone) as mentioned above. In this embodiment, the spring-loaded nozzle element comprises a nozzle cone, and an elongate stem which is integrally connected to the nozzle cone and extends axially therefrom. The nozzle cone has a tapered outer surface. The stem is advanced through the central bore of the nozzle housing. The fixed nozzle element is disposed within the nozzle cone of the spring-loaded nozzle element, and fluidly communicates within one or more flow passages formed within the nozzle cone.

In the spray nozzle assembly including the spray nozzle sub-assembly of the first embodiment, a biasing spring circumvents a portion of the stem, and normally biases the spring-loaded nozzle element to a closed position. In greater detail, the biasing spring is operatively captured between the nozzle housing and a nozzle shield movably attached or interfaced to a portion of the nozzle housing.

In the spray nozzle assembly including the spray nozzle sub-assembly of the first embodiment, cooling water is introduced into each of the flow passage sections at the first end of the nozzle housing, and thereafter flows therethrough into the fluid chamber. When the spring-loaded nozzle element is in its closed position, a portion of the outer surface of the nozzle cone thereof is seated against the seating surface defined by the nozzle housing, thereby blocking the flow of fluid out of the fluid chamber and hence the spray nozzle assembly. An increase of the pressure of the fluid beyond a prescribed threshold effectively overcomes the biasing force exerted by the biasing spring, thus facilitating the actuation of the spring-loaded nozzle element from its closed position to its open position. When the spring-loaded nozzle element is in its open position, the nozzle cone thereof and the that portion of the nozzle housing defining the seating surface collectively define an annular outflow opening between the fluid chamber and the exterior of the nozzle assembly. The shape of the outflow opening, coupled with the shape of the nozzle cone of the spring-loaded nozzle element, effectively imparts an outer conical spray pattern of small droplet size to fluid flowing from the spray nozzle assembly between the nozzle cone and the nozzle housing. At the same time, fluid flows through the flow passage(s) formed in the nozzle cone to and through the fixed nozzle element as facilitates the formation of an inner conical spray pattern of small droplet size which is concentrically positioned within the outer conical spray pattern. A fluid pressure level within the fluid chamber which is insufficient to overcome the biasing force exerted by the biasing spring as needed to facilitate the actuation of the spring-loaded nozzle element to its open position is likewise insufficient to facilitate the generation of the inner conical spray pattern from the fixed nozzle element despite the flow of fluid thereto via the flow passages within the nozzle cone of the spring-loaded nozzle element. Further, with the biasing spring being captured between the first end of the nozzle housing and the nozzle shield and disposed within the interior of the nozzle shield, such biasing spring is effectively shielded or protected from any directly impingement from fluid flowing through the spray nozzle assembly.

In a second embodiment of the present invention, the spray nozzle sub-assembly of the spray nozzle assembly comprises a pair of spring-loaded primary and secondary nozzle elements. In this embodiment, each of the primary and secondary nozzle elements comprises a nozzle cone, and an elongate stem which is integrally connected to the nozzle cone and extends axially therefrom. A nozzle element passage extends axially through the stem and the nozzle cone of the primary nozzle element, and accommodates the secondary nozzle element in a concentrically nested fashion. In addition, portions of the stems if each of the primary and secondary nozzle elements are formed to define a spring. In this embodiment, the spray nozzle assembly collectively defined by the primary and secondary nozzle elements is also adapted to provide an effectively higher spray area through the formation of two water cones.

In the spray nozzle assembly including the spray nozzle sub-assembly of the second embodiment, cooling water is introduced into each of the flow passage sections at the first end of the nozzle housing, and thereafter flows therethrough into the fluid chamber. When the primary nozzle element is in its closed position, a portion of the outer surface of the nozzle cone thereof is seated against the seating surface defined by the nozzle housing. Similarly, when the secondary nozzle element is in its closed position, a portion of the outer surface of the nozzle cone thereof is seated against a complimentary seating surface defined by the nozzle cone of the primary nozzle element. With the primary and secondary nozzle elements each being in their closed position, any flow of fluid out of the fluid chamber and hence the spray nozzle assembly is effectively blocked thereby.

Fluid flowing into the fluid chamber from the flow passage sections of the nozzle housing is able to reach the outer surface of the nozzle cone of the secondary nozzle element by flowing through openings within the stem of the primary nozzle element as defined by the formation of the spring portion therein. An increase of the pressure of the fluid beyond a first prescribed threshold effectively overcomes the biasing force exerted by the biasing spring portion of the stem of the secondary nozzle element, thus facilitating the actuation thereof from its closed position to its open position relative to the primary nozzle element. When the secondary nozzle element is in its open position, the nozzle cone thereof and that portion of the nozzle cone of the primary nozzle element defining the complimentary seating surface collectively define an annular outflow opening. The shape of the outflow opening, coupled with the shape of the nozzle cone of the secondary nozzle element, effectively imparts an inner conical spray pattern of small droplet size to fluid flowing from the spray nozzle assembly between the nozzle cones of the primary and secondary nozzle elements of the spray nozzle sub-assembly. An increase of the pressure of the fluid beyond a second prescribed threshold effectively overcomes the biasing force exerted by the biasing spring portion of the stem of the primary nozzle element, thus facilitating the actuation thereof from its closed position to its open position relative to the nozzle housing. When the primary nozzle element is in its open position, the nozzle cone thereof and the that portion of the nozzle housing defining the seating surface collectively define an annular outflow opening between the fluid chamber and the exterior of the nozzle assembly. The shape of this outflow opening, coupled with the shape of the nozzle cone of the primary nozzle element, effectively imparts an outer conical spray pattern of small droplet size to fluid flowing from the spray nozzle assembly between the nozzle cone and the nozzle housing.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
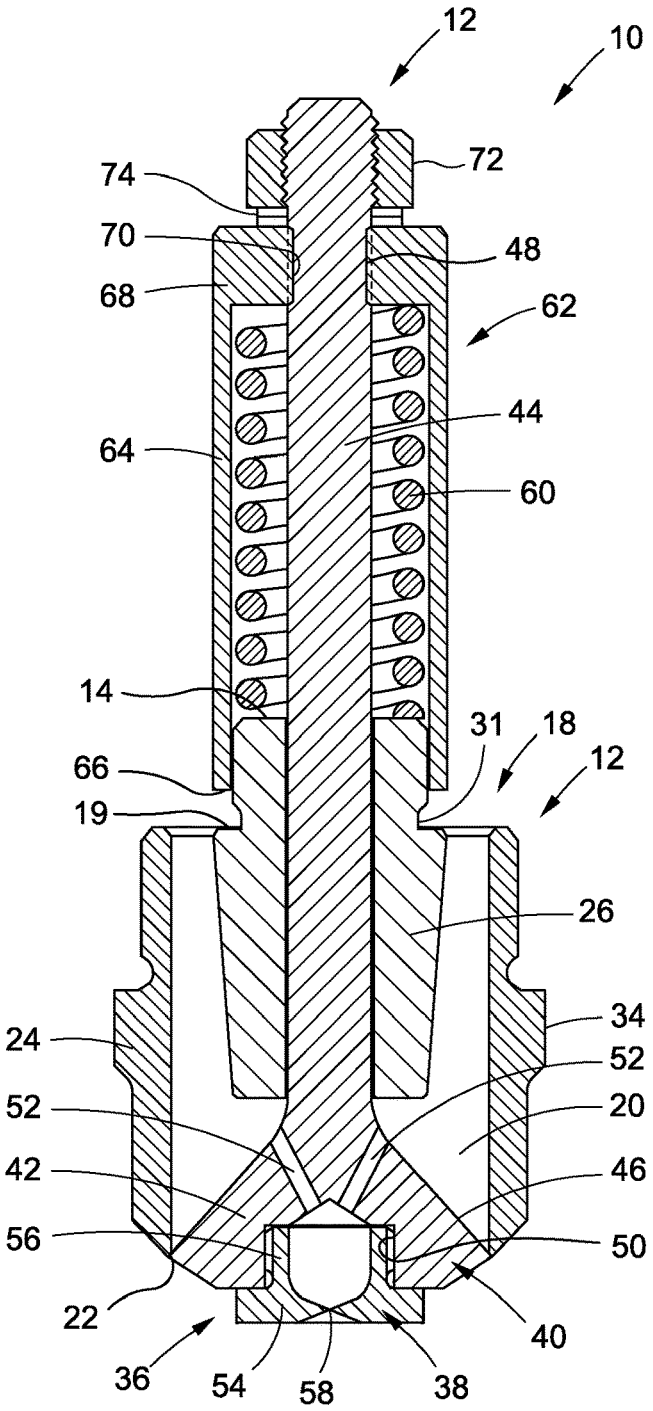
FIG. 1 is a cross-sectional view of a spray nozzle assembly outfitted with a spray nozzle sub-assembly constructed in accordance with a first embodiment of the present invention, the spray nozzle sub-assembly being depicted in a closed or off position.
Figure 2:
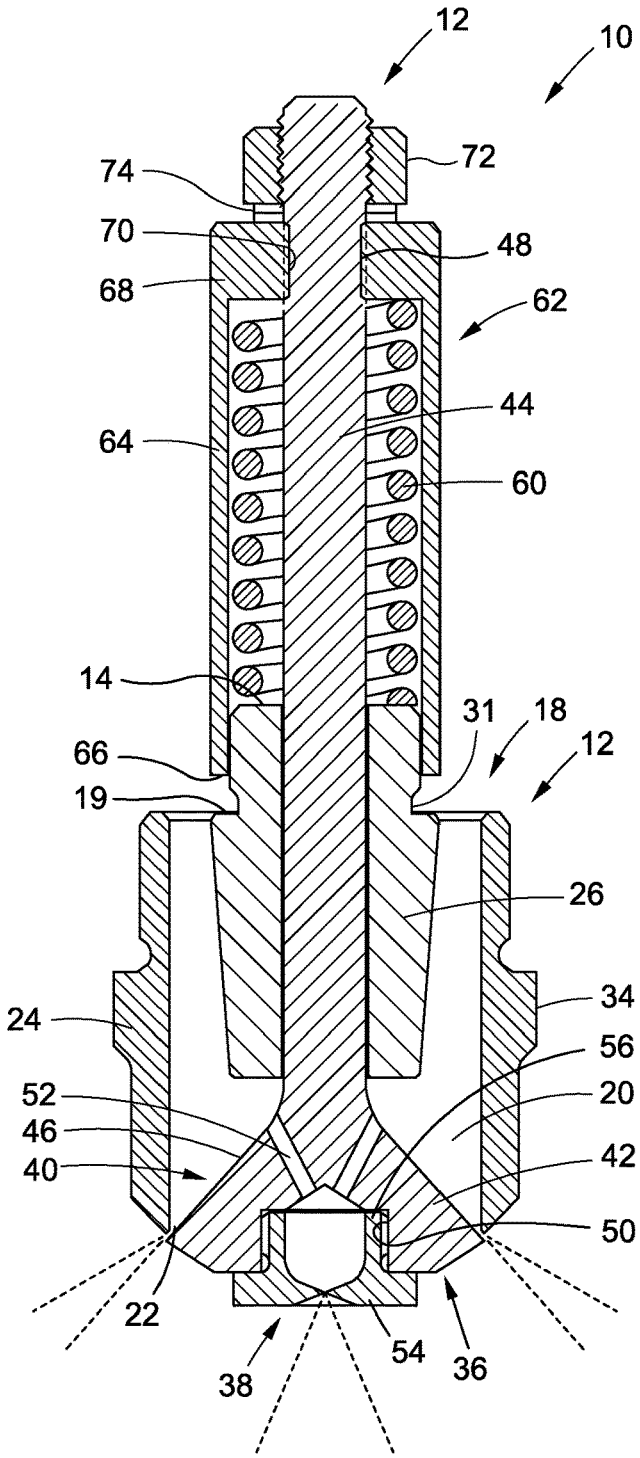
FIG. 2 is a cross-sectional view similar to FIG. 1, but depicting spray nozzle sub-assembly of the first embodiment in an open or on position.
Figure 3:
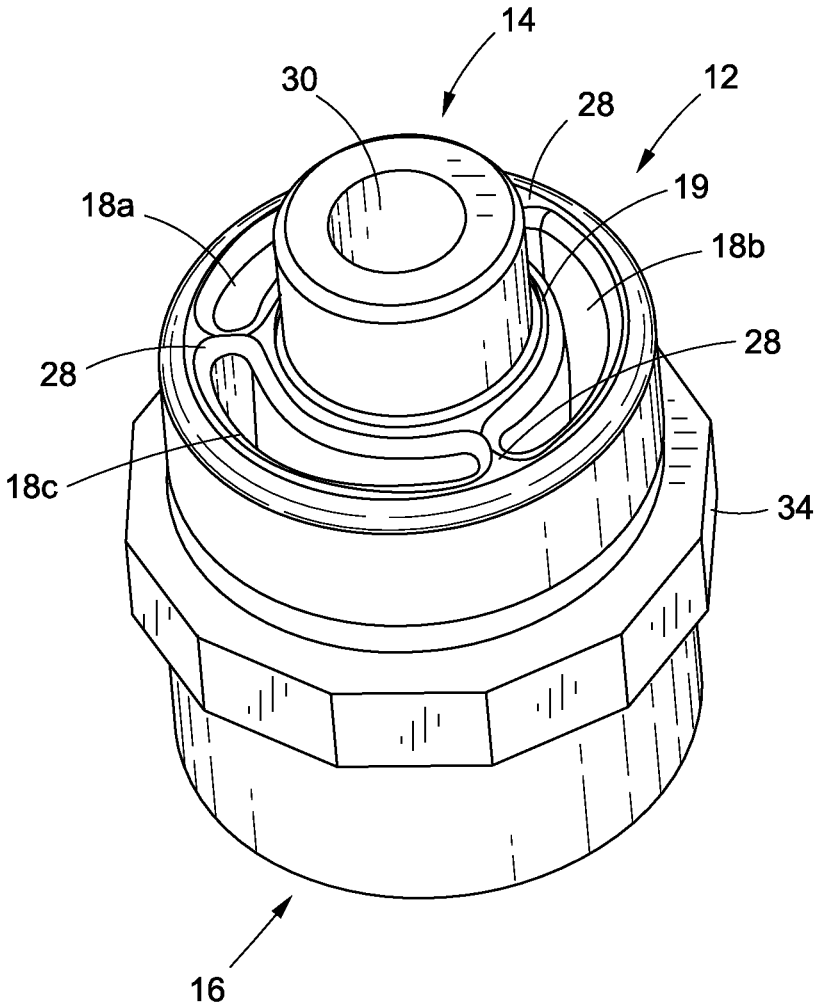
FIG. 3 is a top perspective view of the nozzle housing of the spray nozzle assembly shown in FIGS. 1 and 2.

Referring now to the drawings wherein the showings are for purposes of illustrating preferred embodiments of the present invention only, and not for purposes of limiting the same, FIGS. 1-3 depict a spray nozzle assembly 10 which is outfitted with a spray nozzle sub-assembly 36 constructed in accordance with a first embodiment of present invention. In FIG. 1, the spray nozzle sub-assembly 36 is shown in a closed or off position. In FIG. 2, the spray nozzle sub-assembly 36 is shown in an open or on position. The nozzle assembly 10 is adapted for integration into a desuperheating device such as, but not necessarily limited to, a probe type attemperator.

The nozzle assembly 10 comprises a nozzle housing 12 which is shown with particularity in FIG. 3. The nozzle housing 12 has a generally cylindrical configuration and, when viewed from the perspective shown in FIG. 3, defines a first, top end 14 and an opposed second, bottom end 16. The nozzle housing 12 further defines a generally annular flow passage 18. The flow passage 18 comprises three identically configured, arcuate flow passage sections 18*a*, 18*b*, 18*c*, each of which spans an interval of approximately 120°. One end of each of the flow passage sections 18*a*, 18*b*, 18*c* extends to an annular shoulder 19 disposed below the first end 14 of the nozzle housing 12 when viewed from the perspective shown in FIGS. 1 and 2. The opposite end of each of the flow passage sections 18*a*, 18*b*, 18*c* fluidly communicates with a fluid chamber 20 which is also defined by the nozzle housing 12 and extends to the bottom end 16 thereof. A portion of the bottom end 16 of the nozzle housing 12 which circumvents the fluid chamber 20 defines an annular seating surface 22 of the nozzle housing 12, the use of which will be described in more detail below.

The nozzle housing 12 defines a tubular, generally cylindrical outer wall 24, and a tubular, generally cylindrical inner wall 26, a portion of which is concentrically positioned within the outer wall 24. The inner wall 26 is integrally connected to the outer wall 24 by three (3) identically configured spokes 28 of the nozzle housing 12 which are themselves separated from each other by equidistantly spaced intervals of approximately 120°. As best seen in FIG. 3, one end of each of the spokes 128 terminates at the shoulder 19 of the nozzle housing 12, with the opposite end of each spoke 28 terminating at the fluid chamber 20. The inner wall 26 of the nozzle housing 12 defines a central bore 30 thereof. The central bore 30 extends axially within the nozzle housing 12, with one end of the central bore 30 being disposed at the first end 14, and the opposite end terminating at but fluidly communicating with the fluid chamber 20. Due to the orientation of the central bore 30 within the nozzle housing 12, a portion thereof is circumvented by the annular flow passage 18 collectively defined by the separate flow passage sections 18*a*, 18*b*, 18*c*, i.e., the central bore 30 is concentrically positioned relative to the flow passage sections 18*a*, 18*b*, 18*c*.

As further viewed from the perspective shown in FIGS. 1 and 2, the inner wall 26 includes a first, upper section which protrudes from the outer wall 24, and a second, lower section which is concentrically positioned within and therefore circumvented by the outer wall 26, and hence the flow passage 18 collectively defined by the flow passage sections 18*a*, 18*b*, 18*c*. The upper section defines the first end 14 of the nozzle housing 12, as is separated from the second section by a continuous groove or channel 31 which is immediately adjacent the shoulder 19.

In the nozzle assembly 10, the flow passage sections 18*a*, 18*b*, 18*c* are each collectively defined by the outer and inner walls 24, 26 and an adjacent pair of the spokes 28, with the fluid chamber 20 being collectively defined by the outer wall 24 and that end of the inner wall 26 opposite the end defining the first end 14 of the nozzle housing 12. As is most apparent from FIG. 3, a portion of the outer surface of the outer wall 24 is formed to define a multiplicity of flats 34, the use of which will be described in more detail below. In the nozzle assembly 10, it is contemplated that the nozzle housing 12 having the structural features described above may be fabricated from a direct metal laser sintering (DMLS) process in accordance with the teachings of Applicant's U.S. Patent Publication No. 2009/0183790 entitled Direct Metal Laser Sintered Flow Control Element published Jul. 23, 2009, the disclosure of which is incorporated herein by reference. Alternatively, the nozzle housing 12 may be fabricated through the use of a casting process, such as die casting or vacuum investment casting or by machining from a forged bar.

The spray nozzle sub-assembly 36 of the nozzle assembly 10 is moveably interfaced to the nozzle housing 12, and is reciprocally moveable in an axial direction relative thereto between a closed or off position and an open or on/flow position. The spray nozzle sub-assembly 36 comprises a second, fixed nozzle element 38 which is integrated into a first, spring-loaded nozzle element 40. The spring-loaded nozzle element 40 comprises a nozzle cone 42, and an elongate stem 44 which is integrally connected to the nozzle cone 42 and extends axially therefrom. The nozzle cone 42 defines a tapered outer surface 46. The stem 44 of the spring-loaded nozzle element 40 is not of uniform outer diameter. Rather, when viewed from the perspective shown in FIGS. 1 and 2, the upper end portion of the stem 44 proximate the end disposed furthest from the nozzle cone 42 includes a continuous groove or channel 48 formed therein and extending thereabout. The use of the channel 48 will be described in more detail below. The maximum outer diameter of the stem 44 is substantially equal to, but slightly less than, the diameter of the central bore 30.

When viewed from the perspective shown in FIGS. 1 and 2, disposed within the approximate center of the bottom surface of the nozzle cone 42 is a recess 50 which has a generally circular cross-sectional configuration. Additionally, formed within the nozzle cone 42 is at least one, a preferably two or more flow passages 52. One end of each of the flow passages 52 fluidly communicates with the recess 50, with the opposite end extending to the outer surface 46 of the nozzle cone 42. As will be explained in more detail below, when the spray nozzle sub-assembly 36 is operatively coupled to the nozzle housing 12, the flow passages 52 facilitate the fluid communication between the fluid chamber 20 of the nozzle housing 12 and the recess 50 (and hence the fixed nozzle element 38).

The fixed nozzle element 38 of the spray nozzle sub-assembly 36 comprises a circularly configured base portion 54, having an annular flange portion 56 protruding axially from one side of face thereof. As seen in FIGS. 1 and 2, the flange portion 56 is advanced into and secured within the recess 50 defined by the nozzle cone 42 of the spring-loaded nozzle element 40. The advancement of the flange portion 56 into the recess 50 is limited by the abutment of the base portion 54 against the bottom surface of the nozzle cone 42. Formed within the approximate center of the base portion 54 and extending axially therethrough is an outlet orifice 58 of the fixed nozzle element 38. The outlet orifice 58 is of a prescribed size and configured such that when fluid is forced therethrough at or above a prescribed pressure level, a generally conical spay pattern is imparted to fluid being expelled from the outlet orifice 58. It is contemplated that the fixed nozzle element 38 can be integrally machined into the nozzle cone 42, and further that the nozzle cone 42 can be die casted or laser sintered directly in the final shape of entire assembly. It is also contemplated that the flow passages 52 can be drilled in an asymmetric shape that can facilitate the formation of a swirled flow which is adapted to produce better performances of atomization of the fixed nozzle 38 element 38.

In the nozzle assembly 10, the stem 44 of the spring-loaded nozzle element 40 of the spray nozzle sub-assembly 36 is advanced through the central bore 30 such that the nozzle cone 42 predominately resides within the fluid chamber 20. The length of the stem 44 relative to that of the bore 30 is such that when the nozzle cone 42 resides within the fluid chamber 20, a substantial portion of the length of the stem 44 protrudes from the inner wall 26, and hence the first end 14 of the nozzle housing 12.

The nozzle assembly 10 further comprises a helical biasing spring 60 which circumvents a substantial portion of that segment of the stem 44 protruding from the first end 14 of the nozzle housing 12. The biasing spring 60 preferably resides within the interior of a nozzle shield 62 of the nozzle assembly 10 which is movably attached to the nozzle housing 12, and in particular that first section of the inner wall 26 thereof. The nozzle shield 62 has a generally cylindrical, tubular configuration. When viewed from the perspective shown in FIGS. 1 and 2, the nozzle shield 62 includes a side wall portion 64 which has a generally circular cross-sectional configuration, and defines a distal end or rim 66. That end of the side wall portion 64 opposite the distal rim 66 transitions to an annular flange portion 68 which extends radially inward relative to the side wall portion 64, and defines a circumferential inner surface 70.

In the nozzle assembly 10, the nozzle shield 62 is cooperatively engaged to both the nozzle housing 12 and the stem 44. More particularly, the flange portion 68 is partially received into the channel 48 of the stem 44 which preferably has a complementary configuration. At the same time, the first section of the inner wall 26 of the nozzle housing 12 is slidably advanced into the interior of the nozzle shield 62 via the open end thereof defined by the distal rim 66. In this regard, the inner diameter of the side wall portion 64 is sized so as to only slightly exceed the outer diameter of the first section of the inner wall 26, thus providing a slidable fit therebetween. When the nozzle shield 62 assumes this orientation relative to the nozzle housing 12 and stem 44, the biasing spring 60 circumvents that portion of the outer surface of the stem 44 which extends between the first end 14 and the flange portion 68. In this regard, as also viewed from the perspective shown in FIGS. 1 and 2, the top end of the biasing spring 60 is abutted against the interior surface of the flange portion 68, with the opposite, bottom end of the biasing spring 60 being abutted against the first end 14. As such, the biasing spring 60 is effectively captured between the nozzle shield 62 and the nozzle housing 12 within the interior of the nozzle shield 62.

In the nozzle assembly 10, the biasing spring 60 is operative to normally bias the spring-loaded nozzle element 40 of the spray nozzle sub-assembly 36 136 to its closed position shown in FIG. 1. In this regard, when the spring-loaded nozzle element 40 is in its closed position, a gap is defined between the distal rim 66 of the nozzle shield 62 and the shoulder 19 defined by the nozzle housing 12. As will be described in more detail below, the abutment of the distal rim 66 against the shoulder 19 functions as a mechanical stop in the nozzle assembly 10 as governs the orientation of the nozzle cone 42 of the spring-loaded nozzle element 40 relative to the nozzle housing 12 when the spray nozzle sub-assembly 36 (and in particular the spring-loaded nozzle element 40 thereof) is actuated to its fully open position.

In the nozzle assembly 10, the spring-loaded nozzle element 40, and hence the spray nozzle sub-assembly 36, is maintained in cooperative engagement to the nozzle housing 12 and the nozzle shield 62 through the use of a locking nut 72 and a complimentary pair of lock washers 74. As seen in FIGS. 1 and 2, the annular lock washers 74 are advanced over that portion of the stem 44 which normally protrudes from the flange portion 68 of the nozzle shield 62, and effectively compressed and captured between the locking nut 72 and the exterior top surface defined by the flange portion 68. In this regard, that portion of the stem 44 protruding from the flange portion 68 is preferably externally threaded, thus allowing for the threadable engagement of the locking nut 72 thereto.

As indicated above, the spray nozzle sub-assembly 36 of the nozzle assembly 10 (and in particular the spring-loaded nozzle element 40 thereof) is selectively moveable between a closed position (shown in FIG. 1) and an open or flow position (shown in FIG. 2). When the spray nozzle sub-assembly 36 is in either of its closed or open positions, the biasing spring 60 is confined or captured within the interior of the nozzle shield 62, and thus covered or shielded thereby. Irrespective of whether the spray nozzle sub-assembly 36 is in its closed or opened positions, at least a portion of the upper section of the inner wall 26 remains or resides in the interior of the nozzle shield 62.

When the spray nozzle sub-assembly 36 is in its closed position, a portion of the outer surface 46 of the nozzle cone 42 of the spring-loaded nozzle element 40 is firmly seated against the complimentary seating surface 22 defined by the nozzle housing 12, and in particular the outer wall 24 thereof. At the same time, the aforementioned gap is defined between the distal rim 66 of the nozzle shield 62 and the shoulder 19 defined by the nozzle housing 12. The biasing spring 60 captured within the interior of the nozzle shield 62 and extending between the flange portion 68 thereof and the first end 14 of the nozzle housing 12 acts against the spray nozzle sub-assembly 36 in a manner which normally biases the same to its closed position. In this regard, the biasing spring 60 normally biases the nozzle shield 62 in a direction away from the nozzle housing 12, which in turn biases the spray nozzle sub-assembly 36 to its closed position relative to the nozzle housing 12 by virtue of the partial receipt of the flange portion 68 into the complimentary channel 48 of the stem 44 of the spring-loaded nozzle element 40.

In the nozzle assembly 10, cooling water is introduced into each of the flow passage sections 18*a*, 18*b*, 18*c* at the ends thereof disposed closest to the first end 14 of the nozzle housing 12, and thereafter flows therethrough into the fluid chamber 20. When the spray nozzle sub-assembly 36 is in its closed position, the seating of the outer surface 46 of the nozzle cone 42 of the spring-loaded nozzle element 40 against the seating surface 22 blocks the flow of fluid out of the fluid chamber 20 between nozzle cone 42 of the spring-loaded nozzle element 40 and the nozzle housing 12. Though fluid flowing into the fluid chamber 20 further flows into the recess 50 (and hence to the fixed nozzle element 38) via the flow passages 52 within the nozzle cone 42, a fluid pressure level within the fluid chamber 20 which is insufficient to overcome the biasing force exerted by the biasing spring 60 as needed to facilitate the actuation of the spray nozzle sub-assembly 36 to its open position is nonetheless able to facilitate fluid through the outlet orifice 58 of the fixed nozzle element 38, allowing for the partial operation of the spring loaded nozzle assembly 40 via flow through outlet orifice 58 and the subsequent formation of the internal cone of water mist.

An increase of the pressure of the fluid in the fluid chamber 20 beyond a prescribed threshold effectively overcomes the biasing force exerted by the biasing spring 60, thus facilitating the actuation of the spray nozzle sub-assembly 36 from its closed position to its open position. More particularly, when viewed from the perspective shown in FIGS. 1 and 2, the compression of the biasing spring 60 facilitates the downward axial travel of the spray nozzle sub-assembly 36 relative to the nozzle housing 12. As indicated above, the downward axial travel of the spray nozzle sub-assembly 36 is limited by the abutment of a distal rim 66 of the nozzle shield 62 against the shoulder 19 defined by the nozzle housing 12.

When the spray nozzle sub-assembly 36 is in its open position, the nozzle cone 42 of the spring-loaded nozzle element 40 thereof and that portion of the nozzle housing 12 defining the seating surface 22 collectively define an annular outflow opening between the fluid chamber 20 and the exterior of the nozzle assembly 10. The shape of such outflow opening, coupled with the shape of the nozzle cone 42, effectively imparts a conical spray pattern (i.e., an outer conical spray pattern) of small droplet size to the fluid flowing through such outflow opening. At the same time, fluid flows through the flow passage(s) 52 formed in the nozzle cone 42 to and through the outlet orifice 58 of the fixed nozzle element 38 as facilitates the formation of an another conical spray pattern (i.e., an outer conical spray pattern) of small droplet size which is concentrically positioned within the outer conical spray pattern. As will be recognized, a reduction in the fluid pressure flowing through the nozzle assembly 10 below a threshold which is needed to overcome the biasing force exerted by the biasing spring 60 effectively facilitates the resilient return of the spray nozzle sub-assembly 36 from its open position shown in FIG. 2 back to its closed position as shown in FIG. 1.

Importantly, fluid flow through the nozzle assembly 10, and in particular the flow passage sections 18*a*, 18*b*, 18*c* and fluid chamber 20 thereof, normally bypasses the central bore 30 and is further prevented from directly impinging the biasing spring 60 by virtue of the same residing within the interior of and thus being covered by the nozzle shield 62 in the aforementioned manner. Thus, even when the nozzle assembly 10 heats up to full steam temperature when no water is flowing and is shocked when impinged with cold water, the level of thermal shocking of the biasing spring 60 will be significantly reduced, thereby lengthening the life thereof and minimizing occurrences of spring breakage. Further, as is most apparent from FIG. 3, the inflow ends of the flow passage sections 18*a*, 18*b*, 18*c* at the first end 14 of the nozzle housing 12 are radiused, which increases the capacity thereof. This shape of the inflow ends is a result of the use of the DMLS or casting process described above to facilitate the fabrication of the nozzle housing 112.

In addition, in the nozzle assembly 10, the travel of the spray nozzle sub-assembly 36 from its closed position to its open position is limited mechanically by the abutment of the shoulder 19 of the nozzle housing 12 against the rim 66 of the nozzle shield 62 in the above-described manner. This mechanical limiting of the travel of the spray nozzle sub-assembly 36 eliminates the risk of compressing the biasing spring 60 solid, and further allows for the implementation of precise limitations to the maximum stress level exerted on the biasing spring 60, thereby allowing for more accurate calculations of the life cycle thereof. Still further, the aforementioned mechanical limiting of the travel of the spray nozzle sub-assembly 36 substantially increases the pressure limit of the nozzle assembly 10 since it is not limited by the compression of the biasing spring 60. This also provides the potential to fabricate the nozzle assembly 10 in a smaller size to function at higher pressure drops, and to further provide better primary atomization with higher pressure drops. The mechanical limiting of the travel of the spray nozzle sub-assembly 36 also allows for the tailoring of the flow characteristics of the nozzle assembly 10, with the cracking pressure being controlled through the selection of the biasing spring 60.

In the spray nozzle sub-assembly 36 of the present invention, the fixed nozzle element 38 works in concert with the spring-loaded nozzle element 40 to provide better control over droplet size at low flow/low pressure drop conditions. In addition, such spray nozzle sub-assembly 36 is adapted to improve water droplet fractionation at higher flow rates while further providing an effectively higher spray area through the formation of two water cones (rather than a single water cone) as mentioned above. Various nozzle assemblies suitable for having the spray nozzle sub-assembly 36 of the present invention integrated therein are disclosed in Applicant's U.S. application Ser. No. 14/042,428 entitled Improved Nozzle Design For High Temperature Attemperators filed Sep. 30, 2013, the disclosure of which is incorporated herein by reference.

Figure 4:
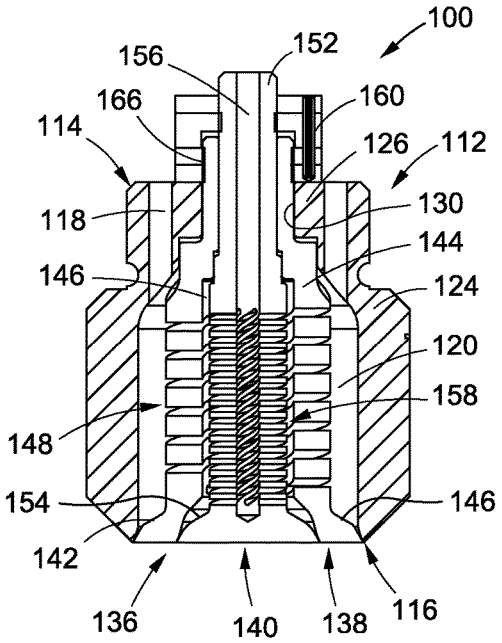
FIG. 4 is a cross-sectional view of a spray nozzle assembly outfitted with a spray nozzle sub-assembly constructed in accordance with a second embodiment of the present invention, the spray nozzle sub-assembly being depicted in a closed or off position.

Referring now to FIGS. 4-8, there is shown a spray nozzle assembly 100 which is outfitted with a spray nozzle sub-assembly 136 constructed in accordance with a second embodiment of present invention. In FIG. 4, the spray nozzle sub-assembly 136 is shown in a closed or off position. In FIG. 3, the spray nozzle sub-assembly 136 is shown in a partially open or on position. In FIG. 4, the spray nozzle sub-assembly 36 is shown in a fully open or on position. The nozzle assembly 100 is also adapted for integration into a desuperheating device such as, but not necessarily limited to, a probe type attemperator.

The nozzle assembly 100 comprises a nozzle housing 112. The nozzle housing 2 has a generally cylindrical configuration and, when viewed from the perspective shown in FIGS. 4-6, defines a first, top end 114 and an opposed second, bottom end 116. The nozzle housing 112 further defines a generally annular flow passage 118. The flow passage 118 preferably comprises two or more arcuate flow passage sections which each span a prescribed interval. One end of each of the flow passage sections extends to the first end 114, with the opposite end of each of the flow passage sections fluidly communicating with a fluid chamber 120 which is also defined by the nozzle housing 112 and extends to the bottom end 116 thereof. A portion of the bottom end 116 of the nozzle housing 112 which circumvents the fluid chamber 120 defines an annular seating surface 122 of the nozzle housing 112, the use of which will be described in more detail below.

The nozzle housing 112 defines a tubular, generally cylindrical outer wall 124, and a tubular, generally cylindrical inner wall 126 which is concentrically positioned within the outer wall 124. The inner wall 126 is integrally connected to the outer wall 124 by one or more spokes of the nozzle housing 112. The inner wall 126 of the nozzle housing 112 defines a central bore 130 thereof. The central bore 130 extends axially within the nozzle housing 112, with one end of the central bore 130 being disposed at the first end 114, and the opposite end terminating at but fluidly communicating with the fluid chamber 120. Due to the orientation of the central bore 130 within the nozzle housing 112, the same is circumvented by the annular flow passage 118 collectively defined by the separate flow passage sections, i.e., the central bore 130 is concentrically positioned relative to such flow passage sections. In the nozzle assembly 100, it is contemplated that the nozzle housing 112 having the structural features described above may be fabricated from a direct metal laser sintering (DMLS) process in accordance with the teachings of Applicant's U.S. Patent Publication No. 2009/0183790 described above. Alternatively, the nozzle housing 112 may be fabricated through the use of a casting process, such as die casting or vacuum investment casting.

The spray nozzle sub-assembly 136 of the nozzle assembly 100 is moveably interfaced to the nozzle housing 112, and is reciprocally moveable in an axial direction relative thereto between a closed or off position, a partially open or on/flow position, and a fully open or on/flow position. The spray nozzle sub-assembly 136 comprises a spring-loaded primary nozzle element 138 and a spring-loaded secondary nozzle element 140 which is integrated into and concentrically positioned within the primary nozzle element 138. The primary nozzle element 138 comprises a nozzle cone 142, and an elongate stem 144 which is integrally connected to the nozzle cone 142 and extends axially therefrom. The nozzle cone 142 defines a tapered outer surface 146. As is apparent from FIGS. 4-6, the primary nozzle element 138 has a tubular configuration, defining a bore 146 which extends axially through the nozzle cone and stem portions 142, 144 thereof. Neither the stem 144 nor the bore 146 is of uniform diameter. Rather, as viewed from the perspective shown in FIGS. 4-6, both the stem 144 and the bore 146 define separate sections which are of progressively increasing diameter from the top end to the bottom end of the primary nozzle element 138. The outer diameter of uppermost section of the stem 144 is substantially equal to, but slightly less than, the diameter of the central bore 130.

In the primary nozzle element 138, the lowermost section of the stem 144 which is of a prescribed outer diameter and terminates at the nozzle come 142 is formed to define a helical spring portion 148 which extends along a majority of the length thereof. When the spray nozzle sub-assembly 136 is operatively coupled to the nozzle housing 112, the openings in the stem 144 defined by the formation of the spring portion 148 therein create a fluid path between the fluid chamber 120 and the bore 146 of the primary nozzle element 138.

Similar to the primary nozzle element 138, the secondary nozzle element 140 comprises a nozzle cone 150, and an elongate stem 152 which is integrally connected to the nozzle cone 150 and extends axially therefrom. The nozzle cone 150 defines a tapered outer surface 154. As is apparent from FIGS. 4-6, the stem 152 is not of uniform outer diameter. Rather, as viewed from the perspective shown in FIGS. 4-6 and 8, the stem 152 defines separate sections which are of progressively increasing diameter from the top end of the stem 152 to the nozzle cone 150 of the secondary nozzle element 140. The outer diameter of uppermost section of the stem 152 is substantially equal to, but slightly less than, the inner diameter of the uppermost section of the bore 146 defined by the primary nozzle element 138. Extending axially through the stem 152 is an elongate bore 156. One end of the bore 156 extends to the top end of the stem 152, with the opposite end terminating at approximately the nozzle cone 150 of the secondary nozzle element 140.

In the secondary nozzle element 140, the lowermost section of the stem 152 which is of a prescribed outer diameter and terminates at the nozzle come 150 is formed to define a helical spring portion 158 which extends along a majority of the length thereof. When the spray nozzle sub-assembly 136 is operatively coupled to the nozzle housing 112, the openings in the stem 152 defined by the formation of the spring portion 158 therein create a fluid path between the bore 146 of the primary nozzle element 138 and the bore 156 of the secondary nozzle element 140. Thus, the bore 156 is effectively placed into fluid communication with the fluid chamber 120 via the bore 146 of the primary nozzle element 138 and openings defined by the spring portions 148, 158. Importantly, for reasons which will be described in more detail below, the spring portions 148, 158 are formed to have differing spring constants as allows the spring portion 158 of the secondary nozzle element 140 to be compressed at a lower force threshold than that of the spring portion 148 of the primary nozzle element 138.

Figure 5:
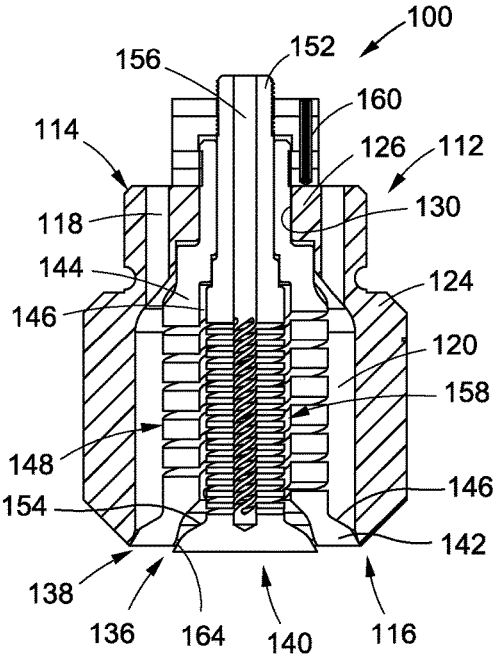
FIG. 5 is a cross-sectional view similar to FIG. 4, but depicting spray nozzle sub-assembly of the second embodiment in a partially open or on position.
Figure 6:
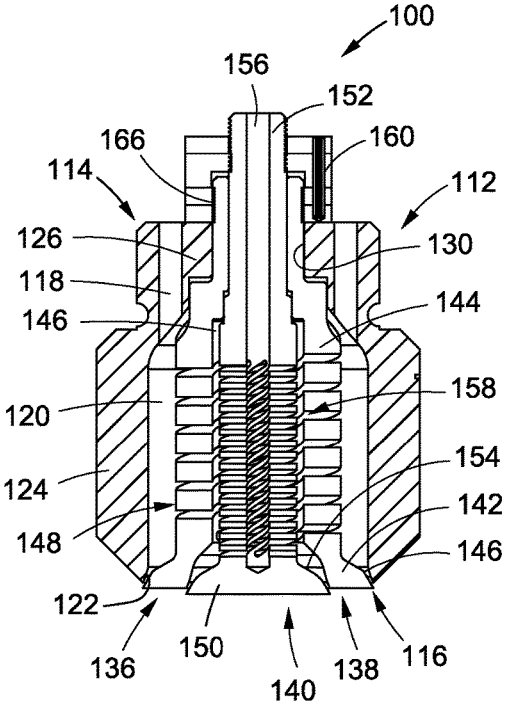
FIG. 6 is a cross-sectional view similar to FIG. 4, but depicting spray nozzle sub-assembly of the second embodiment in a fully open or on position.
Figure 7:
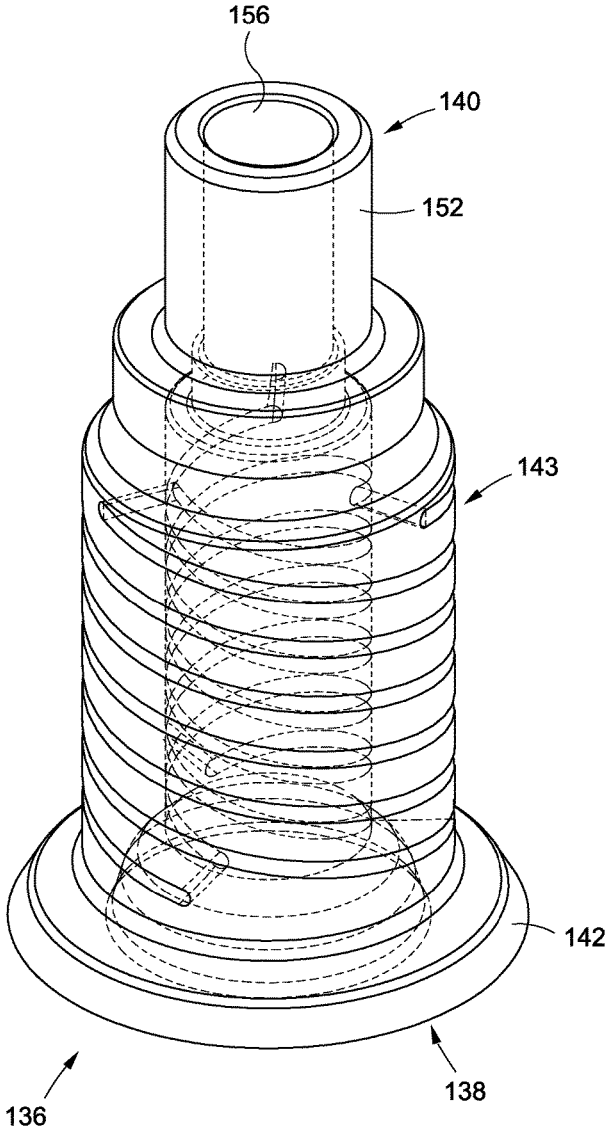
FIG. 7 is a top perspective view of the spray nozzle sub-assembly of the second embodiment as removed from within the nozzle housing of the spray nozzle assembly as shown in FIGS. 4-6.
Figure 8:
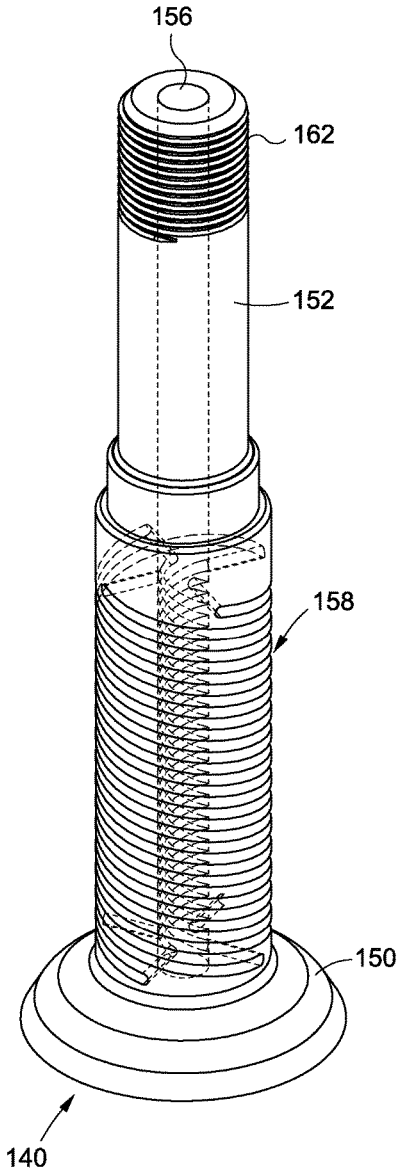
FIG. 8 is a top perspective view of the secondary nozzle element of the spray nozzle sub-assembly of the second embodiment as removed from within the primary nozzle element thereof.

As further seen in FIGS. 4-6, in the nozzle assembly 100, the uppermost section of the stem 144 of the primary nozzle element 138 of the spray nozzle sub-assembly 136 is advanced through the central bore 130 of the nozzle housing 112 such that the nozzle cone 142 predominately resides within the fluid chamber 120. The length of the stem 144 relative to that of the bore 130 is such that when the nozzle cone 142 resides within the fluid chamber 120, a portion of the length of the stem 144 protrudes from the inner wall 126, and hence the first end 114 of the nozzle housing 112. Similarly, in the spray nozzle sub-assembly 136 as integrated into the nozzle assembly 100, the stem 152 of the secondary nozzle element 140 is advanced through the bore 146 of the primary nozzle element 138 such that the nozzle cone 150 resides within the interior of the nozzle cone 142 in the manner shown in FIG. 4. The length of the stem 152 relative to that of the bore 146 is such that when the nozzle cone 150 resides within the nozzle cone 142, a portion of the length of the stem 152 protrudes from the stem 144, and hence from the first end 114 of the nozzle housing 112.

In the nozzle assembly 100, the spray nozzle sub-assembly 136 is maintained in cooperative engagement to the nozzle housing 112 through the use of a locking assembly 160. As seen in FIGS. 4-6, the locking assembly 160 is advanced over and cooperatively engaged to those portions of the stems 144, 152 which protrude from the nozzle housing 112. In this regard, a portion of the stem 152 protruding from the stem 144 is preferably provided with external threads 162 which are threadably engaged to complimentary internal threads defined by the locking assembly 160. In addition, a radially inwardly extending flame portion defined by the locking assembly 160 is received into a complimentary groove or channel 166 defined by the portion of the stem 144 protruding directly from the nozzle housing 112. In the nozzle assembly 100, the locking assembly 160 is adapted to maintain those sections of the stems 144, 152 other than those defining the spring portions 148, 158 in fixed relation to the nozzle housing 112.

As indicated above, the spray nozzle sub-assembly 136 of the nozzle assembly 100 is selectively moveable between a closed position (shown in FIG. 4), a partially open position (shown in FIG. 5), and a fully open position (shown in FIG. 6). The spring portion 148 of the primary nozzle element 138 is operative to normally bias the same to a closed position as shown in FIGS. 4 and 5. Similarly, the spring portion 158 of the secondary nozzle element 140 is operative to normally bias the same to a closed position as shown in FIG. 4. When the spray nozzle sub-assembly 136 is in its closed position, a portion of the outer surface 146 of the nozzle cone 142 of the primary nozzle element 138 is firmly seated against the complimentary seating surface 122 defined by the nozzle housing 112, and in particular the outer wall 124 thereof. At the same time, a portion of the outer surface 154 of the nozzle cone 150 of the secondary nozzle element 140 is firmly seated against a complimentary seating surface 164 defined by the nozzle cone 142 of the primary nozzle element 138.

In the nozzle assembly 100, cooling water is introduced into each of the flow passage 118 at the first end 114 of the nozzle housing 112, and thereafter flows therethrough into the fluid chamber 120. When the spray nozzle sub-assembly 136 is in its closed position, the seating of the nozzle cone 142 against the complimentary seating surface 122 defined by the nozzle housing 112 and the seating of the nozzle cone 150 against the complimentary seating surface 164 defined by the nozzle cone 142 of the primary nozzle element 138 blocks the flow of fluid out of the fluid chamber 120, and hence the nozzle assembly 100. As will be recognized, fluid flowing into the fluid chamber 120 further flows into both the bore 146 of the primary nozzle element 138 via the openings defined by the spring portion 148 thereof, and thereafter into the bore 156 of the secondary nozzle element 140 via the openings defined by the spring portion 158 thereof. However, if the fluid pressure level within the fluid chamber 120 and bores 146, 156 acting against the nozzle cones 142, 150 is insufficient to overcome the biasing forces exerted by each of the spring portions 148, 158, the spray nozzle sub-assembly 136 will remain in its closed position.

An increase of the pressure of the fluid in the fluid chamber 120 and bores 146, 156 beyond a first prescribed threshold effectively overcomes the biasing force exerted by the spring portion 158 of the secondary nozzle element 140 (which is lower than that exerted by the spring portion 148 of the primary nozzle element 138), thus facilitating the actuation of the secondary nozzle element 140 from its closed position (shown in FIG. 4) to an open position (as shown in FIGS. 5 and 6). This opening of only the secondary nozzle element 140 places the spray nozzle sub-assembly 136 into its partially open position. When viewed from the perspective shown in FIGS. 5 and 6, the compression of the spring portion 158 facilitates the downward axial travel of the secondary nozzle element 140 relative to both the primary nozzle element 138 and the nozzle housing 112. This in turn results in the outer surface 154 of the nozzle cone 150 of the secondary nozzle element 140 and that portion of the nozzle cone 142 defining the seating surface 164 collectively defining an annular outflow opening. The shape of such outflow opening, coupled with the shape of the nozzle cone 150, effectively imparts a conical spray pattern (i.e., an inner conical spray pattern) of small droplet size to the fluid flowing through such outflow opening.

An increase of the pressure of the fluid in the fluid chamber 120 and bores 146, 156 beyond a second prescribed threshold exceeding the first effectively overcomes the biasing force exerted by the spring portion 148 of the primary nozzle element 138 (which is higher than that exerted by the spring portion 158 of the secondary nozzle element 140 as indicated above), thus facilitating the actuation of the primary nozzle element 138 from its closed position (shown in FIGS. 4 and 5) to an open position (as shown in FIG. 6). This opening of the primary nozzle element 138 concurrently with the opening of the secondary nozzle element 140 places the spray nozzle sub-assembly 136 into its fully open position. When viewed from the perspective shown in FIG. 6, the compression of the spring portion 148 facilitates the downward axial travel of the primary nozzle element 138 relative to the nozzle housing 112. This in turn results in the outer surface 146 of the nozzle cone 142 of the primary nozzle element 138 and that portion of the nozzle housing 112 defining the seating surface 122 collectively defining an annular outflow opening. The shape of such outflow opening, coupled with the shape of the nozzle cone 142, effectively imparts a conical spray pattern (i.e., an outer conical spray pattern) of small droplet size to the fluid flowing through such outflow opening. Thus, with the spray nozzle sub-assembly 136 being in its fully open position, two conical spray patterns of cooling water are produced by the nozzle assembly 100, the inner being concentrically positioned within the outer.

Importantly, the increase of the fluid pressure in the fluid chamber 120 and bores 146, 156 beyond the second prescribed threshold as is needed to facilitate the movement of the primary nozzle element 138 axially downwardly to its open position by virtue of the compression of its spring portion 148, facilitates an even greater level of compression in the spring portion 158 of the secondary nozzle element 140 in comparison to the compression level resulting from the fluid pressure in the fluid chamber 120 and bores 146, 156 going beyond the first prescribed threshold as facilitates the movement of the secondary nozzle element 140 to its open position. This added degree of axial movement of the secondary nozzle element 140 which occurs simultaneously with the axial movement of the primary nozzle element 138 maintains the annular outflow opening between the nozzle cones 142, 150 despite the uppermost sections of the stems 144, 152 each being fixedly mounted to the nozzle housing 112 by the locking assembly 160. As will be recognized, a reduction in the fluid pressure flowing through the nozzle assembly 100 below the second threshold which is needed to overcome the biasing force exerted by the spring portion 148 effectively facilitates the resilient return of the primary nozzle element 138 to its closed position, and hence the spray nozzle sub-assembly 136 from its fully open position shown in FIG. 6 back to its partially open position as shown in FIG. 5. A further reduction in the fluid pressure flowing through the nozzle assembly 100 below the first threshold which is needed to overcome the biasing force exerted by the spring portion 158 effectively facilitates the resilient return of the secondary nozzle element 140 to its closed position, and hence the spray nozzle sub-assembly 136 from its partially open position shown in FIG. 5 back to its closed position as shown in FIG. 4.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A spray nozzle sub-assembly for a desuperheating device, comprising:

a first nozzle element defining a nozzle cone having a recess and at least one flow passage formed therein, with the recess fluidly communicating with the at least one flow passage; and a second nozzle element cooperatively engaged to the nozzle cone and fluidly communicating with the flow passage and the recess therein;

the second nozzle element having an outlet orifice that is of a fixed size and shape and is defined solely by the second nozzle element, the outlet orifice extending through the second nozzle element and in fluid communication with the at least one flow passage, the second nozzle element being sized and structured to independently facilitate the transmission of a generally conical spray pattern therefrom as liquid flows through the outlet orifice;

the at least one flow passage, the recess, and the outlet orifice being arranged serially such that fluid flows sequentially through the at least one flow passage, then through the recess, and then through the outlet orifice.

2. The spray nozzle sub-assembly of claim 1 further in combination with:

a nozzle housing defining a seating surface and having a flow passage extending therethrough, the first nozzle element being movably attached to the nozzle housing and selectively movable between closed and open positions relative thereto, a portion of the nozzle cone of the first nozzle element being seated against the seating surface in a manner blocking fluid flow through the flow passage of the nozzle housing when the first nozzle element is in the closed position, with portions of the nozzle housing and the nozzle cone of the first nozzle element collectively defining an outflow opening which facilities fluid flow through and out of the flow passage of the nozzle housing when the first nozzle element is in the open position.

3. The spray nozzle sub-assembly of claim 2 further in combination with:

a nozzle shield movably attached to the nozzle housing and cooperatively engaged to the first nozzle element such that the movement of the nozzle shield facilitates the concurrent movement of the first nozzle element; and a biasing spring disposed within the nozzle shield and cooperatively engaged thereto, the biasing spring being operative to normally bias the first nozzle element to the closed position;

wherein the nozzle shield is sized and configured such that the biasing spring disposed therein is effectively shielded from direct impingement of cooling water flowing into the flow passage of the nozzle housing.

4. The spray nozzle sub-assembly of claim 3 wherein the nozzle housing defines a fluid chamber which is circumvented by the seating surface and fluidly communicates with the flow passage thereof, and the flow passage of the nozzle housing has a generally annular configuration which partially circumvents at least a portion of the first nozzle element.

5. The spray nozzle sub-assembly of claim 4 wherein the flow passage of the nozzle housing comprises three separate flow passage segments which each fluidly communicate with the fluid chamber and each span a circumferential interval of approximately 120°.

6. The nozzle assembly of claim 4 wherein the nozzle housing comprises:

an outer wall; and an inner wall which is concentrically positioned relative the outer wall and defines a central bore which fluidly communicates with the fluid chamber;

the flow passage of the nozzle housing and the fluid chamber each being collectively defined by portions of the outer and inner walls, with a portion of the first nozzle element residing within the central bore.

7. The spray nozzle sub-assembly of claim 6 wherein the first nozzle element comprises an elongate stem which extends axially from the nozzle cone and through the central bore, a portion of the stem extending within the nozzle shield and being circumvented by the biasing spring.

8. The spray nozzle sub-assembly of claim 6 wherein:

the inner wall of the nozzle housing defines an annular shoulder; and the nozzle shield defines a distal rim which is sized and configured to abut the shoulder when the first nozzle element is in the open position.

9. The spray nozzle sub-assembly of claim 1, wherein the outlet orifice is sized and structured to facilitate fluid flow through the second nozzle element.

10. The spray nozzle sub-assembly of claim 1, wherein the second nozzle element is integral with the first nozzle element.

11. The spray nozzle sub-assembly of claim 1, wherein the outlet orifice is in an open configuration independent of fluid flowing therethrough.

12. A spray nozzle sub-assembly for a desuperheating device, comprising:

a nozzle housing having a flow passage extending therethrough;

a first nozzle element having at least one flow passage and a recess formed therein with the recess fluidly communicating with the at least one flow passage, the first nozzle element being movably attached to the nozzle housing and selectively movable between closed and open positions relative thereto, the first nozzle element further being sized and configured to block fluid flow through the flow passage of the nozzle housing when in the closed position, with the nozzle housing and the first nozzle element collectively defining an outflow opening which facilities fluid flow through and out of the flow passage of the nozzle housing when the first nozzle element is in the open position; and a second nozzle element cooperatively engaged to the first nozzle element and fluidly communicating with the flow passage and the recess thereof;

the second nozzle element having an outlet orifice formed solely by the second nozzle element, the outlet orifice being in an open configuration independent of fluid flowing therethrough, the outlet orifice being sized and structured to facilitate the transmission of a prescribed spray pattern therefrom;

the at least one flow passage, the recess, and the outlet orifice being arranged serially such that fluid flows sequentially through the at least one flow passage, then through the recess, and then through the outlet orifice.

13. The spray nozzle sub-assembly of claim 12 wherein:

the nozzle housing defines a seating surface; and a portion of the first nozzle element is seated against the seating surface in a manner blocking fluid flow through the flow passage of the nozzle housing when the first nozzle element is in the closed position.

14. The spray nozzle sub-assembly of claim 13 further in combination with:

a nozzle shield movably attached to the nozzle housing and cooperatively engaged to the first nozzle element such that the movement of the nozzle shield facilitates the concurrent movement of the first nozzle element; and a biasing spring disposed within the nozzle shield and cooperatively engaged thereto, the biasing spring being operative to normally bias the first nozzle element to the closed position;

wherein the nozzle shield is sized and configured such that the biasing spring disposed therein is effectively shielded from direct impingement of cooling water flowing into the flow passage of the nozzle housing.

15. The spray nozzle sub-assembly of claim 12, wherein the outlet orifice is sized and structured to facilitate fluid flow through the second nozzle element.

16. The spray nozzle sub-assembly of claim 12, wherein the second nozzle element is integral with the first nozzle element.

17. The spray nozzle sub-assembly of claim 12, wherein the outlet orifice is in fluid communication with the at least one flow passage formed in the first nozzle element.

* * * * *